US010699864B2

(12) United States Patent
Geffroy et al.

(10) Patent No.: US 10,699,864 B2
(45) Date of Patent: Jun. 30, 2020

(54) METHOD FOR CONTROLLING AN ACTUATOR DEVICE, ASSOCIATED ACTUATOR DEVICE AND ASSOCIATED SWITCHING UNIT

(71) Applicant: Schneider Electric Industries SAS, Rueil Malmaison (FR)

(72) Inventors: Vincent Geffroy, Faramans (FR); Julien Henri-Rousseau, Grenoble (FR)

(73) Assignee: Schneider Electric Industries SAS, Rueil Malmaison (FR)

( * ) Notice: Subject to any disclaimer, the term of this patent is extended or adjusted under 35 U.S.C. 154(b) by 492 days.

(21) Appl. No.: 15/690,582

(22) Filed: Aug. 30, 2017

(65) Prior Publication Data

US 2018/0068817 A1 Mar. 8, 2018

(30) Foreign Application Priority Data

Sep. 2, 2016 (FR) ..... 16 58195

(51) Int. Cl.
*H01H 47/32* (2006.01)
*H01H 47/00* (2006.01)
(Continued)

(52) U.S. Cl.
CPC ..... *H01H 47/325* (2013.01); *H01F 7/1844* (2013.01); *H01H 47/002* (2013.01);
(Continued)

(58) Field of Classification Search
CPC .... H01H 47/325; H01H 47/002; H01H 50/54; H01H 50/18; H01H 2047/006; H01F 7/1844; H01F 2007/1866
(Continued)

(56) References Cited

U.S. PATENT DOCUMENTS 5,160,928 A * 11/1992 Rigat-Esselin ..... H01H 47/325 137/636.2
5,708,355 A * 1/1998 Schrey ..... F01L 9/04 323/282

(Continued)

OTHER PUBLICATIONS

French Preliminary Search Report dated May 16, 2017 in French Application 16 58195 filed on Sep. 2, 2016 (with English Translation of Categories of Cited Document).

*Primary Examiner* — Dharti H Patel
(74) *Attorney, Agent, or Firm* — Oblon, McClelland, Maier & Neustadt, L.L.P.

(57) ABSTRACT

A method is provided for controlling an actuator comprising an electromagnet and a control device, the electromagnet including a coil and a moving part that moves between a first position and a second position, the control device including a power supply member configured to supply the coil with an electric current having a voltage and an amperage and a measurement member for measuring a value of a quantity from among the voltage and the amperage. The method includes acquiring samples of the measured value, of regulating, according to a proportional-integral-derivative algorithm, the electric current to around a setpoint value that is equal to a maintenance value capable of maintaining the moving part in the second position, of comparing each sample to a predetermined threshold and of detecting a movement of the moving part if a single sample is above or equal to the threshold.

11 Claims, 4 Drawing Sheets

Figure 1:
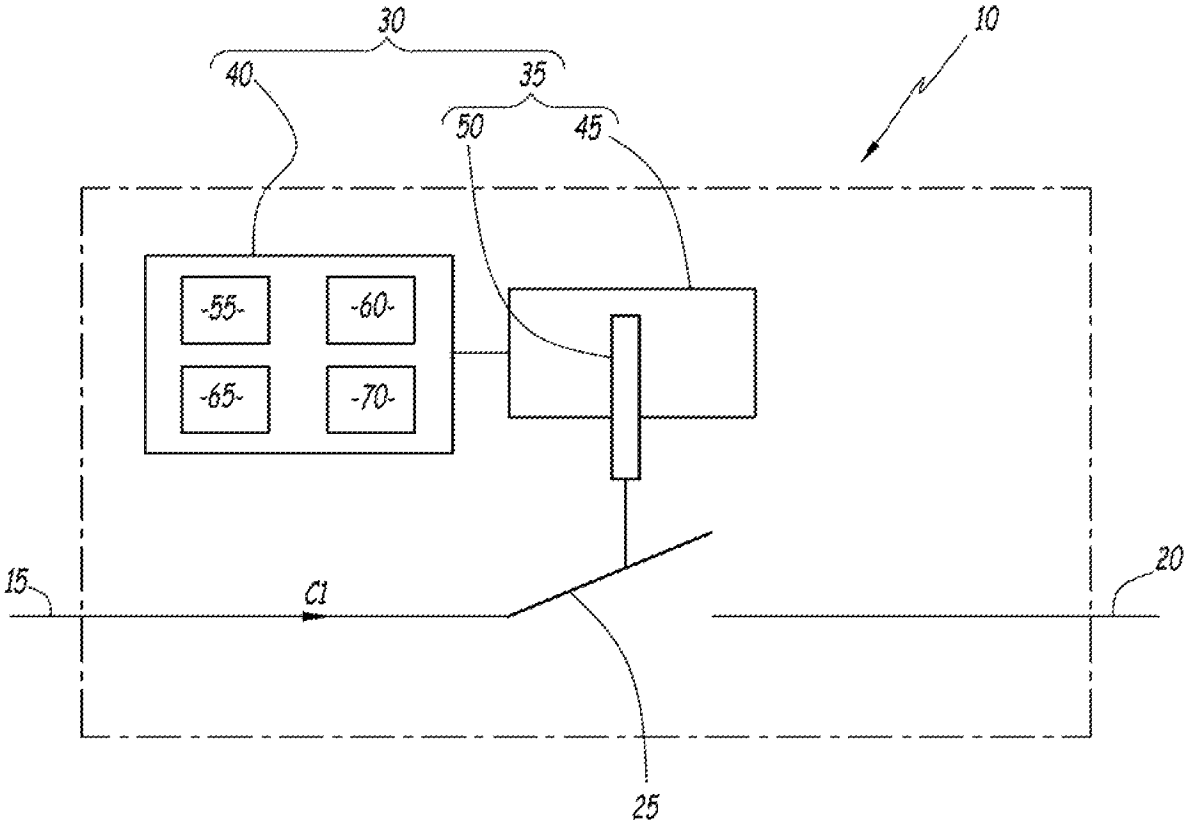

(51) Int. Cl.
*H01F 7/18* (2006.01)
*H01H 50/18* (2006.01)
*H01H 50/54* (2006.01)

(52) U.S. Cl.
CPC ..... *H01H 50/18* (2013.01); *H01H 50/54* (2013.01); *H01F 2007/1866* (2013.01); *H01H 2047/006* (2013.01)

(58) Field of Classification Search
USPC ..... 361/152
See application file for complete search history.

(56) References Cited

U.S. PATENT DOCUMENTS 5,933,313 A * 8/1999 Furukawa ..... G05B 11/28 361/152
6,141,201 A * 10/2000 Schmitz ..... H01F 7/1844 361/154
6,188,562 B1 * 2/2001 Lutz ..... B60T 8/36 361/154
6,744,615 B1 * 6/2004 Melbert ..... F01L 9/04 361/154
2011/0170224 A1 * 7/2011 Gietler ..... H01F 7/1844 361/139

* cited by examiner

METHOD FOR CONTROLLING AN ACTUATOR DEVICE, ASSOCIATED ACTUATOR DEVICE AND ASSOCIATED SWITCHING UNIT

The present invention relates to a method for controlling an actuator device. The present invention likewise concerns an actuator device and a switching unit comprising such an actuator device.

It is common for electrical switching devices to have electromagnetic actuator devices. For example, an electromagnet comprises a coil and a moving part which moves relative to the coil. The moving part is, for example, an electric circuit, or perhaps a core. The moving part is received in the coil, the movement of the moving, part being controlled by the circulation of a current in the coil. The moving part is secured mechanically to a movable element forming an electrical contact. The movement of the moving part then allows actuating the movable element and ordering the opening or closing of the electrical contact. For a first value of the current, the moving part moves from a position in which the electrical contact is open to a position in which the electrical contact is closed, or vice versa. In order to ensure the safety of the system, the reverse movement is generally effectuated by a spring, making it possible to ensure the opening of the circuit even in the event of electrical outage. A second value of the current, too low to order the movement of the moving part, nevertheless is able to, offset the action of the spring so as to maintain the contact in the closed position while minimizing, the consumption of electricity of the system.

However, because the force exerted to maintain the contact closed is relatively slight, such electrical contacts are liable to open if an outside impact causes the movement of the moving part relative to the coil. The untimely opening of electrical contacts may cause them to be heated, to a point where they then become welded together.

Thus, the detection of impacts is often specified during the design of switching devices, to the point where certain of these devices comprise accelerometers for this purpose. However, these accelerometers complicate the design and the control of the switching device, making it more expensive.

From document FR 2786915 A1 there is known a method of control of an actuator device of the aforementioned type, in which the current is regulated to the second value by an algorithm of "regulation peak" kind, in which a switch is open or closed depending on whether a sample of the measured quantity is larger or smaller than a setpoint value. In the event of an impact while the actuator is holding the contact in the closed position, the movement of the moving part relative to the coil is detected if four successive current samples are greater than the setpoint value. In fact, a movement of the moving part causes the appearance in the coil of an electromotive force which causes an increase in the current passing through the coil. In the event of detecting such a movement, the value to which the current is regulated is then increased in order to increase the electromagnetic force exerted on the magnet and again close the electrical contact.

However, such a method of control may prove to be insufficiently rapid to prevent an untimely opening of the electrical contact in the event of a powerful impact, which is liable to damage the switching device. This problem is in part solved by increasing the current value for the phase of holding the contact in the closed position, but such an option causes a greater consumption of electricity.

One purpose of the invention is thus to propose a method of control of an actuator device which is able to maintain the contact in the closed position for larger impacts than in the prior art, without significantly increasing the consumption of electricity.

Accordingly, there is proposed a method for controlling an actuator device comprising an electromagnet and a control device, the electromagnet comprising a coil and a moving part that moves relative to the coil between a first position and a second position, the control device comprising:

- a power supply member configured to supply the coil with an electric current,
- a measurement, member configured to measure at least one value of a measured quantity of the electric current,
- a sampling member configured to acquire at least one sample of the value, and
- a regulator able to regulate the value the measured quantity about a setpoint value.

This method comprises the steps of:

- energizing the electromagnet with the electric current, the measured quantity having a movement value able to cause a movement of the moving part from the first position to the second position,
- moving of the moving part from the first position to the second position,
- acquisition, with a sampling period, of a sample of the measured value,
- regulating of the electric current about a setpoint value by a proportional-integral-derivative algorithm, the setpoint value being greater than or equal to a maintenance value capable of maintaining the moving part in the second position,
- comparing of each sample to a predetermined threshold strictly larger than the maintenance value, and
- detecting of an unwanted movement of the moving part if a single sample is above or equal to the threshold, in absolute value.

According to other advantageous but not obligatory aspects of the invention, the method comprises one or more of the following features, taken alone or in any technically possible combination:

- following the detection of an unwanted movement, the control device carries out a step of energizing the electromagnet with the electric current, the measured quantity having the movement value.
- a difference between the threshold and the maintenance value less than or equal, in absolute value, to 15 percent of the maintenance value, preferably less than or equal to 5 percent of the maintenance value.
- the proportional-integral-derivative algorithm has a proportional coefficient equal to zero.
- the sampling period is less than or equal to 500 microseconds, a proportional coefficient and an integral coefficient being defined for the proportional-integral-derivative algorithm, the proportional coefficient being between 1 percent of the integral coefficient and 10 percent of the integral coefficient.

The invention likewise concerns an actuator device comprising an electromagnet and a control device, the electromagnet comprising a coil and a moving part able to move relative to the coil between a first position and a second position, the control device comprising:

- a power supply member configured to energize the coil with an electric current, the electric current being able to cause a movement of the moving part from the first position to the second position, when a measured quantity of the electric current has a movement value, and, being able to hold the moving part in the second position when this measured quantity has a maintenance value strictly less, in absolute value, than the movement value, a measurement member for measuring at least one value of the measure quantity, a sampling member configured to acquire samples of the measured value, with a sampling period, and a regulator able to regulate the value of the measured quantity about a setpoint value;

the regulator being configured to regulate the value of the measured quantity by a proportional-integral-derivative algorithm, to compare each measured sample to a predetermined threshold strictly greater than the maintenance value and to detect an unwanted movement of the moving part if a single sample of the measured value is greater than or equal to the threshold, in absolute value.

The invention also concerns an electrical switching device comprising an, input terminal, an output terminal, a moving contact and an actuator device able to move the moving contact between a closed position in which the input terminal is electrically connected to the output terminal and an open position in which the input terminal is electrically isolated from the output terminal, the actuator device being as defined above.

Advantageously, the electrical switching device is a contactor.

As a variant, the electrical switching device is a circuit breaker.

According to another variant, the electrical switching device is, an electronic relay.

According to yet another variant, the electrical switching device is a source inverter.

Figure 2:
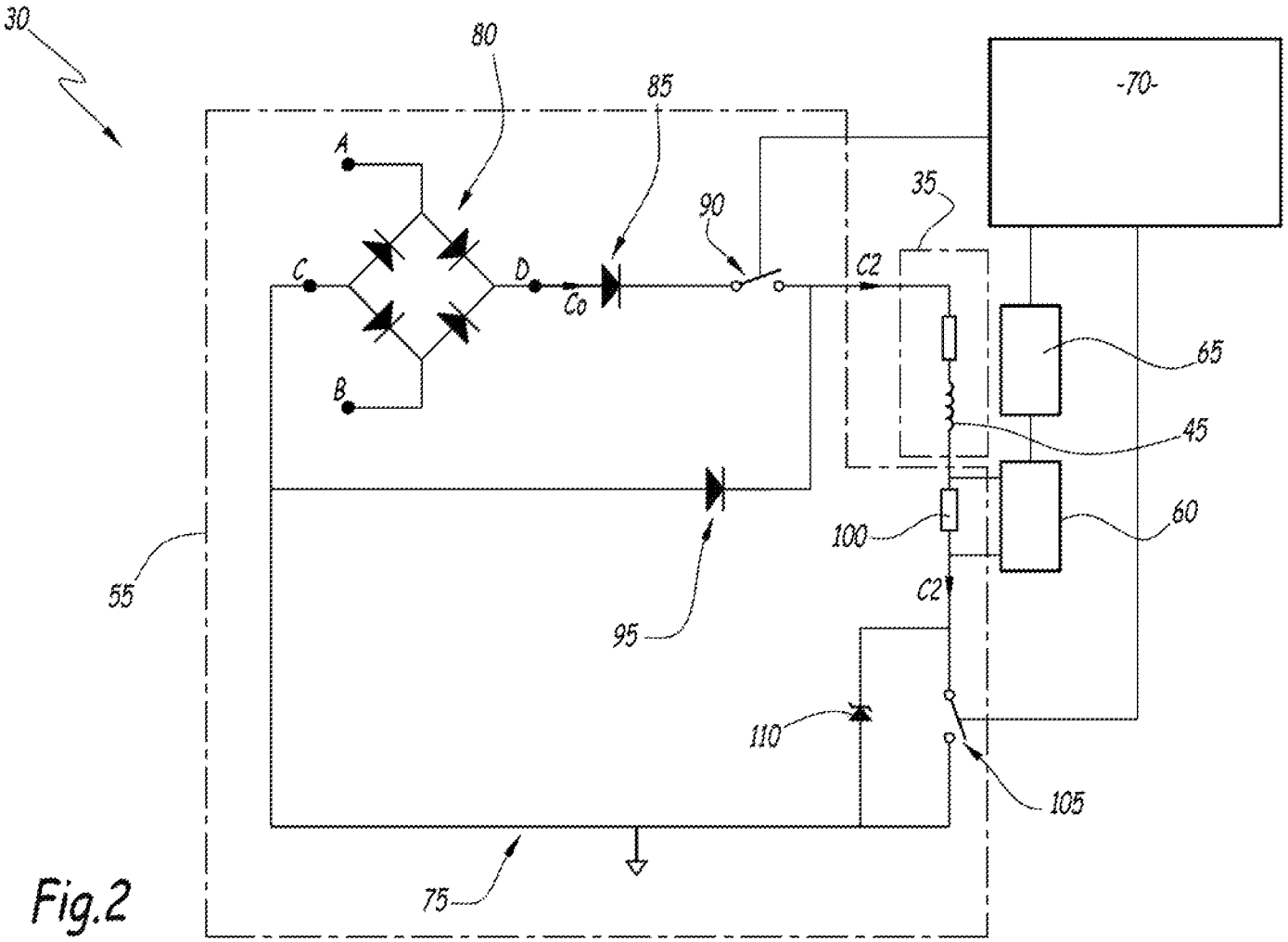
Figure 3:
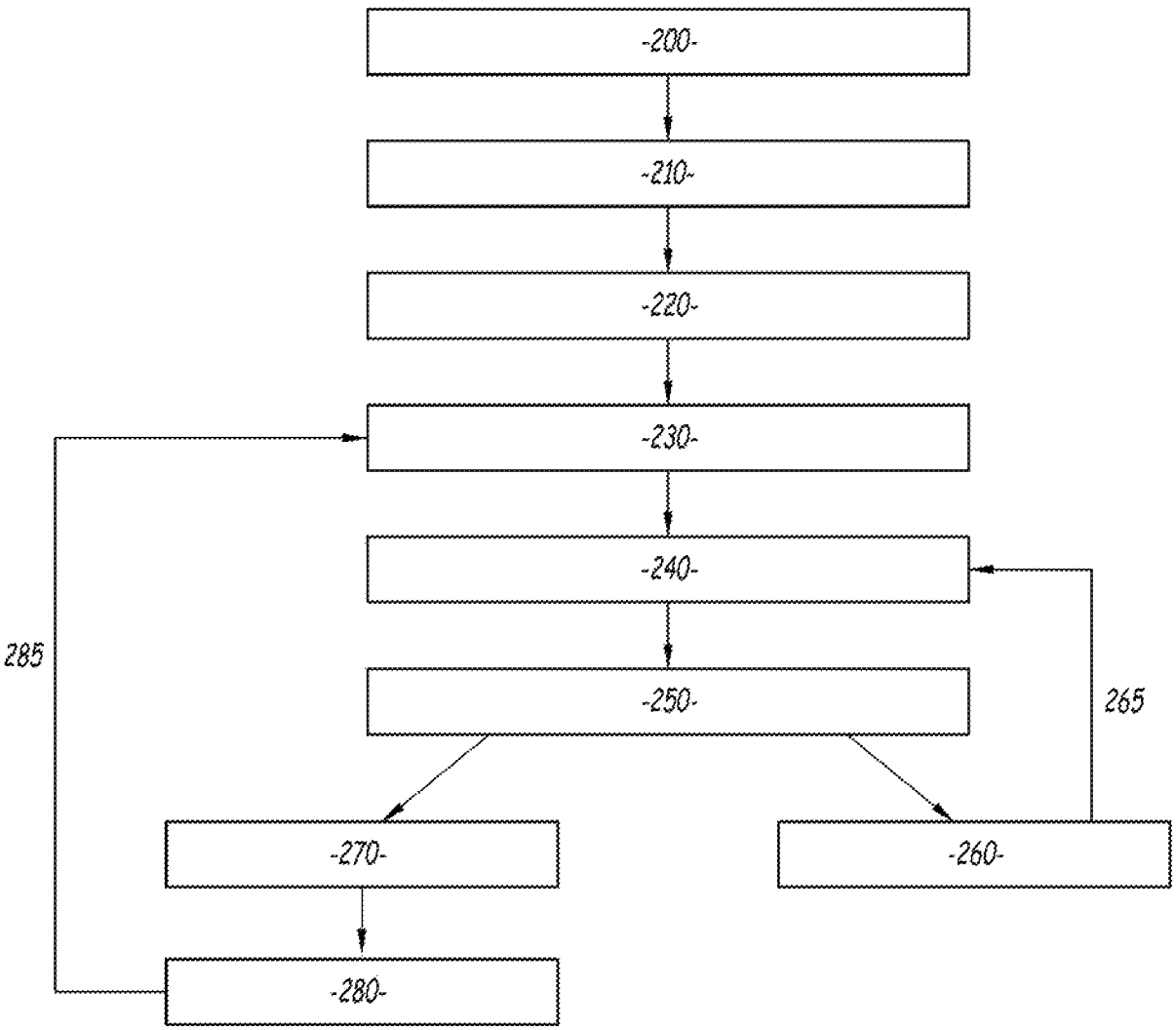
Figure 5:
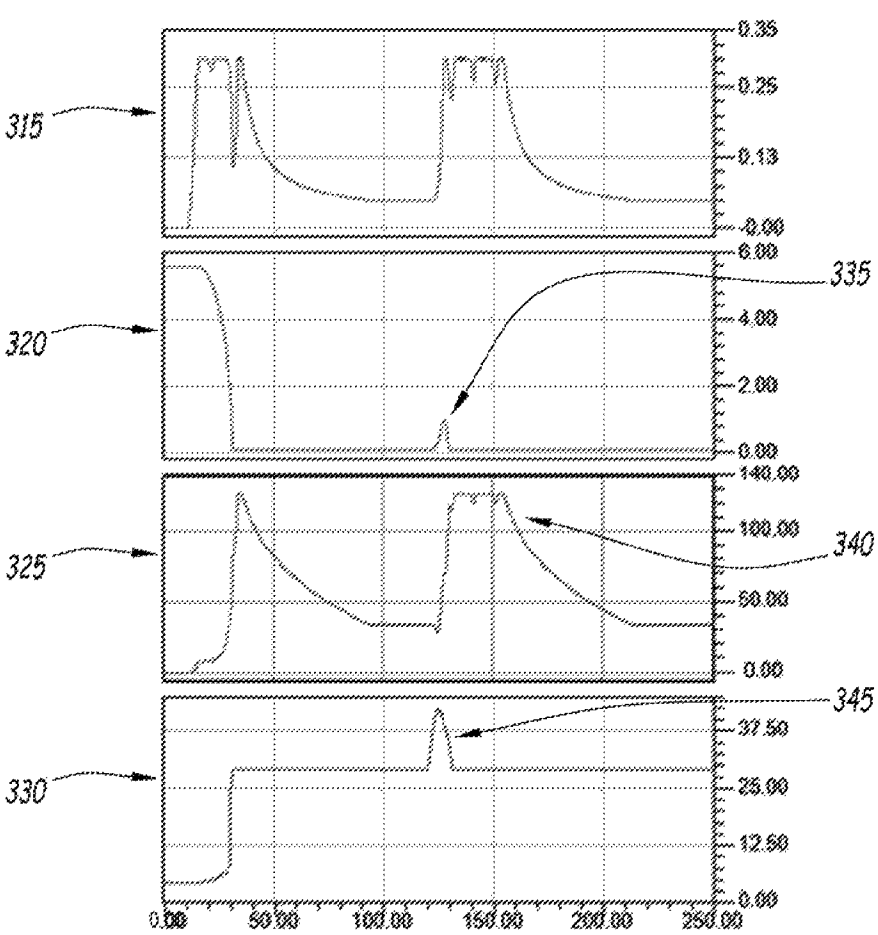
Figure 4:
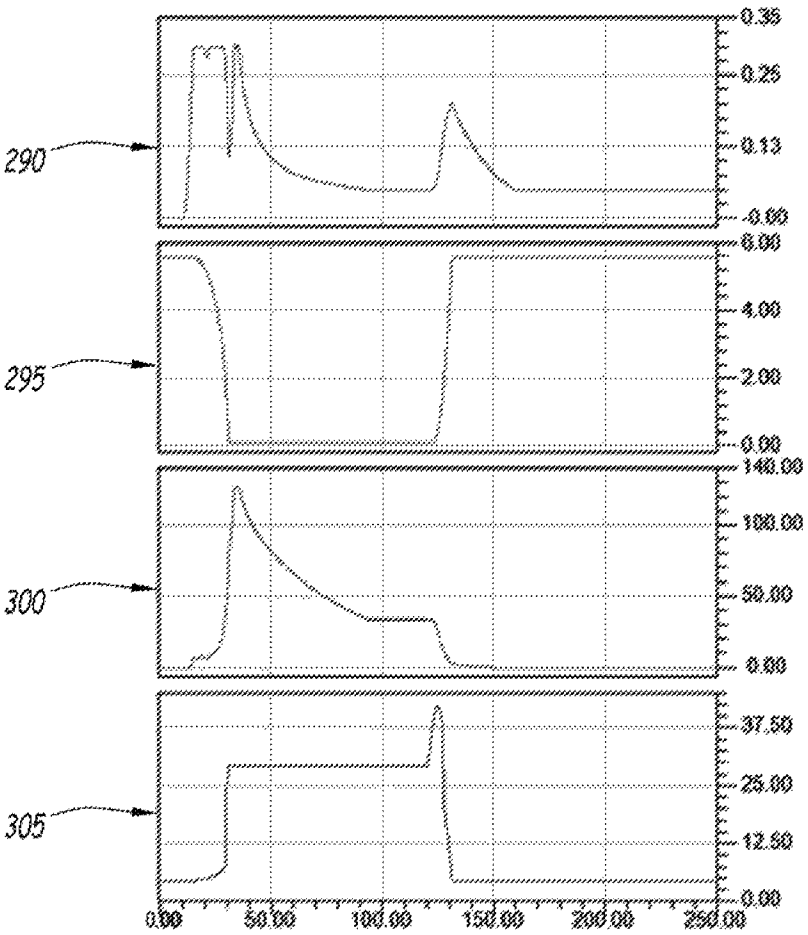

The features and advantages of the invention shall appear upon perusal of the following description, given solely as a nonlimiting example, and making reference to the appended drawings, in which:

FIG. 1 is a diagram of a switching device according to the invention comprising an activation device, FIG. 2 is a diagram of the activation device of the device of FIG. 1, FIG. 3 is a flow chart of the steps of a method of control according to the invention, implemented by the activation device of FIGS. 1 and 2, FIG. 4 is a set of graphs describing the variation of different parameters measured in the course of the implementing of a control method of the prior art, and FIG. 5 is a set of graphs describing the variation of the parameters of FIG. 4, measured in the course of the implementing of a control method according to the invention.

A switching device 10 is represented in FIG. 1.

The switching device 10 comprises an electrical input terminal 15, an electrical output terminal 20, a moving contact 25 and an actuator device 30.

The switching device 10 is configured to receive a first electric current C1 at the electrical input terminal 15 and to deliver the first electric current C1 at the output terminal 20.

The switching device 10 is furthermore configured to electrically disconnect the electrical input terminal 15 from the electrical output terminal 20, that is, to cut out the first electric current C1 between the electrical input terminal 15 and the electrical output terminal 20.

The switching device 10 is, for example, a contactor. In particular, the switching device 10 is configured to electrically connect the electrical input terminal and the electrical output terminal 20 upon reception of a connection command sent by an external device, and to disconnect the electrical input terminal 15 from the electrical output terminal 20 upon reception of a disconnection command sent by said external device.

As a variant, the switching device 10 is a circuit breaker. In particular, the switching device 10 is a trigger of a circuit breaker at minimum voltage, able to disconnect the electrical input terminal 15 from the electrical output terminal 20 upon detection of an untimely drop in voltage.

According to another variant, the switching device 10 is an electronic relay. An electronic relay is a device allowing the switching of an electric current without recourse to mechanical or electromechanical elements.

According to another variant, the switching device 10 is a source inverter. A source inverter is a device able to energize a device with an electric current furnished by one of two sources, and to switch the power supply between the two sources.

The moving contact 25 is connected electrically to the electrical input terminal 15. As a variant, the moving contact 25 is connected electrically to the electrical output terminal 20.

The moving contact 25 can move between an open position and a closed position. When the moving contact 25 is in the open position, the electrical input terminal 15 is not connected electrically to the electrical output terminal 20. When the moving contact 25 is in the closed position, the electrical input terminal 15 is connected electrically by the moving contact 25 to the electrical output terminal 20.

The activation device 30 is configured to move the moving contact 25 between the open position and the closed position, and vice versa.

The activation device 30 is moreover configured to hold the moving contact 25 in the closed position.

The activation device 30 comprises an electromagnet 35 and a control device 40.

The electromagnet 35 comprises a coil 45, also known as the fixed part 35, and a moving part 50.

The coil 45 comprises an electrical conductor wound around an axis.

The moving part 50 is, for example, a core of the electromagnet 35.

The moving part 50 is secured to the moving contact 25 and can move along with it.

The moving part 50 can move between, a first position and a second position in relation to the coil 45. For example, the moving part 50 can move in translation relative to the coil 45 along the axis of the coil 45.

When the moving part 50 is in the first position, the moving part 50 is received, for example, at least partially in the coil 45. When the moving part 50 is in the second position, the moving part 50 is withdrawn at least partially from the coil 45.

Optionally, in addition, the electromagnet 35 comprises a spring able to exert a force on the moving part 50 which tends to bring the moving part 50 from the second position to the first position.

When the moving part 50 is in the first position, the moving contact 25 is in the open position. When the moving part 50 is in the second position, the moving contact 25 is in the closed position.

The control device 40 is configured to command a movement of the moving, pa 50 from the first position to the second position.

The control device 40 comprises a power supply member 55, a measure men member 60, a sampling member 65 and a regulator 70.

The power supply member 55 is configured to energize the coil 45 with a second electric current C2.

The power supply member 55 comprises an electrical circuit 75 as represented in FIG. 2.

The second electric current C2 has an amperage I. The second electric current C2 is able to cause a movement of the moving part 50 from the first position to the second position when a measured quantity G has a movement value Vd. The measured quantity G is for example, the amperage I.

For example, the movement value Vd is between 5 milliamperes (mA) and 25 amperes (A).

As a variant, the measured quantity G is a voltage of the second electric current C2.

The second electric current C2 is furthermore able to hold the moving part 50 in the second position when the measured quantity G is equal to a maintenance value Vm. The maintenance value Vm is strictly less, in absolute value, than the movement value Vd.

For example, the maintenance value is between 5 mA and 25 A.

The power supply member 55 is, for example, configured to generate the second electric current C2 by pulse width modulation.

Pulse width modulation, or PWM, is a technique commonly used to synthesize electric currents in the form of a succession of pulses of very short duration compared to the characteristic times of the systems being energized. For example, by the rapid opening and closing of a switch, a system is energized with an electric current whose mean amperage is fixed by the ratio between the opening and closing times of the switch.

The electrical circuit 75 comprises a rectifier bridge 80, a protection diode 85, a first switch 90, a freewheel diode 95, a measuring resistor 100, a second switch 105 and a Zener diode 110. The electromagnet 35 is represented in the electrical circuit 75 by an inductance and a resistance in series.

The rectifier bridge 80 is configured to receive at its input an input voltage Ua and to transform the input voltage Ua into a fell wave rectified voltage Uc. Thus, the rectifier bridge 80 is configured to put out an origin electric current Co. The origin electric current Co is a current chopped by the switch 90. The input voltage Ua is, for example, an alternating voltage. As a variant, the input voltage tea is a DC voltage.

The input voltage Ua is imposed between the points of the rectifier bridge 80 denoted as "A" and "B" in FIG. 2 by an alternating voltage generator.

The DC voltage Uc is measured between the points denoted as "C" and "D" in FIG. 2.

The protection diode 85 is inserted between the rectifier bridge 80 and the first switch 90, that is, the rectifier bridge 80, the protection diode 85 and the first switch 90 are in series.

The first switch 90 is configured to alternately connect and disconnect the protection diode 85 and the coil 45 depending on a command signal generated by the regulator 70.

The first switch 90 is, for example, a transistor. MOS (metal-oxide semiconductor) transistors are particular examples of transistors. Insulated gate bipolar transistors (IGBT) are other examples of a transistor particularly adapted to high-power circuits.

The first switch 90 is provided to modulate the second current C2 by pulse width modulation based on the origin current Co. In particular, the second current C2 is obtained, based on the origin current Co, by the successive opening and closing of the first switch 90.

The freewheel diode 95 is placed in parallel with the assembly formed by the rectifier bridge 80, the protection diode 85 and the first switch 90.

The measuring resistor 100 is placed in series with the coil 45. In particular, when the second electric current C2 passes through the coil 45, the second electric current C2 likewise passes through the measuring resistor 100. For example, the second electric current C2 passes successively through the coil 45 and the measuring resistor 100.

According to one embodiment, the second switch 105 is inserted, between the ground of the electrical circuit 75 and the measuring resistor 100. The second switch 105 is, for example, a MOS transistor or an IGBT transistor.

The Zener diode 110 is placed in parallel with the second switch 105, in the opposite direction. Thus, the Zener diode 110 protects the second switch 105 against any voltage surge, and also enables a faster discharging of the coil 45 when the second switch 105 is open.

The measurement member 60 is configured to measure a value V of the measured quantity G. For example, the measurement member 60 is configured to measure a voltage on the terminals of the measuring resistor 100 and to calculate the amperage I of the second current C2 from the voltage measured on the terminals of the measuring resistor 100.

As a variant, the measurement member 60 is configured to measure a voltage on the terminals of the coil 45.

The sampling member 65 is configured to acquire samples of the value V with a sampling period Pe, that is, each sample is acquired at a time separated by the sampling period Pe from the times corresponding to the previous sample and the following sample.

The sampling period Pe is, for example, less than or equal to 500 ms. For example, the sampling period Pe is between 300 ms and 500 ms.

As a variant, the sampling period Pe is between 30 ms and 70 ms.

The regulator 70 is configured to regulate the value V of the measured quantity G about a setpoint value Vc.

The regulator 70 is configured to regulate the value V about the setpoint, value Vc by a proportional-integral-derivative algorithm. A proportional-integral-derivative algorithm is a closed-loop control algorithm commonly used in industrial systems. Such an algorithm compares each sample measured to the setpoint value Vc and returns a control variable equal to the sum:

- of the product of a proportional coefficient Kp and a difference calculated between the setpoint Vc and the value of the measured sample,
- of the product of an integral coefficient Ki and the sum of all the differences calculated between the setpoint Vc and the samples measured up to the time in question, and
- of the product of a derivative coefficient Kd and the derivative the value of the difference calculated.

The control variable is, for example, a rate of opening of the first switch 90. The rate of opening is defined as being ratio between the successive durations of opening and closing of the first switch 90.

The regulator 70 is thus configured to regulate the value V of the measured quantity G by pulse width modulation. In particular, the regulator 70 is configured to command the opening and/or closing of the first switch 90 by a proportional-integral-derivative algorithm, as a function of the values of the measured samples.

The regulator 70 is furthermore configured to modify the setpoint value Vc between the maintenance value Vm and the movement value Vd.

The measurement member 60, the sampling member 65 and the regulator 70 are, for example, realized in the form of a programmable logic circuit or as dedicated integrated circuits.

As a variant, the control device 40 comprises a processor and a memory, a measurement software, an acquisition software, and a regulation software, being stored in the memory. When they are executed on the processor, the measurement software, the acquisition software, and the regulation software form respectively the measurement member 60, the acquisition member 65 and the regulator 70.

A flow chart of the steps of a control method of the activation device 30 is represented in FIG. 3.

The control method involves an initial step 200, a first step 210 of energization, a movement step 220, a transition step 230, an acquisition step 240, a comparison step 250, regulating step 260, a detection step 270 and a second energization step 280.

During the initial step 200, the moving part 50 is in the first position. The moving contact 25 is thus in the open position, and the switching device 10 prevents the first current C1 from propagating from the input terminal 15 to the output terminal 20.

During the first energization step 210, the regulator 70 commands tree energizing of the coil 45 with the second electric current C2, the measured quantity G having the movement value Vd. In particular, the regulator 70 sets the setpoint value Vc greater than or equal to the movement value Vd, the acquisition member 65 acquires samples of the value V with the sampling period Pe and the regulator 70 regulates the value V of the measured quantity G about the setpoint value Vc, using a proportional-integral-derivative algorithm.

During the first energization step 210, the derivative coefficient Kd is, for example, equal to 0, that is, the algorithm is a proportional-integral algorithm. A proportional-integral algorithm is a particular instance of a proportional-integral-derivative algorithm.

During the first energization step 210, when the sampling period Pe is less than or equal to 500 ms, the proportional coefficient Kp is, for example, between 1% of the integral coefficient Ki and 10% of the integral coefficient Ki.

After carrying out the first energization step 210, the moving part 50 moves from the first position to the second position during the movement step 220. At the end of the movement step 220, the moving contact 25 is in the closed position.

During the transition step 230, the regulator 70 commands the opening of the first switch 90 and lets the coil 45 discharge, returning, a portion of the electrical energy contained in the coil 45. The current passing through the measuring resistor 100 thus diminishes progressively, starting from the movement value during the discharging of the coil 45.

When the current passing through the measuring resistor 100 reaches the measurement value Vm the regulator 70 carries out the acquisition step 240. During the acquisition step 240, the acquisition member 65 acquires at least one sample of the value V of the measured quantity G. In particular, the acquisition member 65 acquires a single sample of the value V of the measured quantity G.

During the comparison step 250, the regulator compares the measured sample to a predetermined threshold S. The threshold S is comprised strictly between the movement value Vd and the maintenance value Vm. A difference between the threshold S and the maintenance value Vm is less than or equal to, in absolute value, 15 percent of the maintenance value Vm. Preferably, the difference between the threshold S and the maintenance value Vm is less than or equal to, in absolute value, 5 percent of the maintenance value Vm.

If the single sample acquired during the acquisition step 240 is strictly less than the threshold S in absolute value, the comparison step 250 is followed by the regulating step 260.

During the regulating step 260, the regulator 70 commands the energization of the coil 45 with the second electric current C2, the measured quantity G having the movement value Vd. In particular, the regulator 70 sets the setpoint value Vc equal to the movement value Vd and regulates the value V of the measured quantity G about the setpoint value Vc by a proportional-integral-derivative algorithm.

During the regulating step 260, the derivative coefficient Kd is, for example, equal to 0, that is, the algorithm is a proportional-integral algorithm. A proportional-integral algorithm is a particular instance of a proportional-integral-derivative algorithm.

During the regulating step 260, when the sampling period Pe is less than or equal to 500 ms, the proportional coefficient Kp is, for example, between 1% of the integral coefficient Ki and 10% of the integral coefficient Ki.

The steps of acquisition 240, comparison 250 and regulation 260 are repeated successively in this order with the sampling period Pe. This is represented by an arrow 265 in FIG. 3.

If the measured sample is greater than or equal to the threshold S, in absolute value, the comparison step 250 is followed by the detection step 270.

During the detection step 270, the regulator 70 detects an unwanted movement of the moving part 50, that is, the regulator 70 considers that the sample acquired in the acquisition step 240 and compared to the threshold S in the comparison step 250 is greater than or equal to the threshold S on account of an impact resulting in an unwanted movement of the moving part 50. For example, due to an impact, the moving part 50 is found, during the detection step 270, in an intermediate position between the first position and the second position.

The detection step 270 is then followed by the second energization step 280.

During the second energization step 280, the regulator 70 commands the energization of the coil 45 with the second electric current C2, the measured quantity G having the movement value Vd. In particular, the regulator 70 sets the setpoint value Vc equal to the movement value Vd, the acquisition member 65 acquires samples of the value V with the sampling period Pe and the regulator 70 regulates the value V of the measured quantity G about the setpoint value Vc by a proportional-integral-derivative algorithm.

During the second energization step 280, the derivative coefficient Kd is, for example, equal to 0, that is, the algorithm is a proportional-integral algorithm.

During the second energization step 280, when the sampling period Pe is less than or equal to 500 microseconds, the proportional coefficient Kp is, for example, between 1% of the integral coefficient Ki and 10% of the integral coefficient Ki.

Moreover, during the second energization step 280, the moving part 50 moves from the intermediate position to the second position P2 under the effect of the electromagnetic force generated by the passage of the second current C2, the measured quantity C having the movement value Vd, in the coil 45.

After the second energization step 280, the transition step 230 is then carried out once more. This is represented in FIG. 3 by an arrow 285.

Four graphs 290, 295, 300 and 305 are represented in FIG. 4.

The graphs 290 to 305 describe the manner of operation of, a switching device of the prior art, implementing a control method according to the prior art, and, undergoing an impact resulting in an unwanted movement of the moving part 50 of the actuator at a time t equal to around 125 milliseconds.

Graph 290 shows the variation over time of the amperage of the current passing through the coil of the actuator. The impact causes an increase in the current passing through the coil, which appears in the form of a peak 310.

Graph 295 represents the position of the moving part over the course of time, between the second position represented by the ordinate "0" and the first position represented by the ordinate "5.5". The ordinate axis is graduated in millimetres in graph 295.

As can be seen from graph 295, the impact causes the movement of the moving part 50 from the second position to the first position, and the moving part 50 remains in the first position after the impact.

Graph 300 represents the magnetic force exerted by the fixed part of the electromagnet on the moving part 50 over the course of time. As can be seen from graph 300, the magnetic force, exerted does not increase upon detecting the impact.

Graph 305 represents the resistive force exerted by the spring or springs. The resistive force increases at the instant of the impact, then diminishes to a minimal value, a sign that the moving part 50 has reached the first position and is dwelling there.

Four graphs 315, 320, 325 and 330 are represented in FIG. 5.

The graphs 315 to 330 describe the manner of operation of a switching device according to the invention, implementing a control method according to the invention, and undergoing an impact resulting in an unwanted movement of the moving part 50 of the actuator at a time t equal to around 125 milliseconds. Each graph 315, 320, 325 and 330 corresponds respectively to a graph 290, 295, 300 and 305 of FIG. 4 and is represented with the same scales, for comparison.

Graph 315 represents the variation over time of the amperage I of the second current C2 passing through the coil 45. After the impact, the amperage I increases more significantly than in the case of the method of the prior art, and for a longer period. This is due to the detection of the impact by the regulator 70 and the implementing of the second energization step 280.

Graph 320 represents the position of the moving part 50 over the course of time, between the second position represented by the ordinate "0" and the first, position represented by the ordinate "5.5". The ordinate axis is graduated in millimetres in graph 320. As can be seen in graph 320, the impact causes a movement of slight amplitude, visible in the form of a peak 335, of the moving part 50 from the second position in the direction of the first position, but the moving part 50 quickly returns to the second position and dwells there after the impact. This movement is not enough to cause the opening of the moving contact 25.

Graph 325 represents the magnetic force exerted by the fixed part 45 of the electromagnet 35 on the moving part 50 over the course of time. As can be seen from graph 325, the magnetic force exerted increases significantly after detecting the impact. This is visible by the rise in the magnetic force up to a maximum 340 in graph 325, corresponding to a current value Vd. Graph 330 represents the resistive force exerted by the spring or springs. The resistive force increases at the instant of the impact, then returns to the value which it had just prior to the impact, a sign that the moving part returns to the second position and dwells there. This appears in the graph 330 in the form of a peak 345.

Thanks to the use of a proportional-integral-derivative regulating algorithm, the regulation of the measured quantity G is very effective and the second current C2 shows little variation in the absence of an impact. The threshold S is thus close to the maintenance value Vm, and the detection of a single sample greater than or equal to the threshold S makes it possible to detect an impact. The detection of an impact and of the untimely movement of the moving part 50 resulting from this is therefore very rapid. The implementing of the second energization step 280 thus takes place more quickly and the movement of the moving part 50 is thus limited in amplitude, as shown by the peak 335, in FIG. 5.

The risks of opening of the moving contact 25 after an impact are thus reduced, and the switching device 10 is therefore more robust. In particular, the risk of fusion of the moving contact 25 or the input 15 and/or output 20 terminals is thus reduced.

Moreover, the maintenance value Vm is relatively slight. Thus, the electricity consumption of the switching device 10 is reduced.

Furthermore, the switching device 10 contains no movement sensors. The switching device 10 is thus easy to fabricate and control, and less expensive than a switching device having a movement sensor.

The switching device 10 has been described in the case where the moving part 50 of the electromagnet 35 is a core. However, the person skilled in the art will understand that the invention is susceptible to being applied to large variety of electromagnets comprising moving parts of different types.

For example, the moving part is an electrical circuit able to move in relation to the coil 45.

Moreover, the control method has been described in the case where the measured quantity is the amperage of the second current C2. In other embodiments, the measured quantity is a different quantity of the second current C2, such as the voltage of the second current C2.

The invention claimed is:

1. A method for controlling an actuator device comprising an electromagnet and a control device, the electromagnet comprising a coil and a moving part that moves relative to the coil between a first position and a second position, the control device comprising:

a power supply member configured to supply the coil with an electric current, a measurement member configured to measure at least one value of a measured quantity of the electric current, a sampling member configured to acquire at least one sample of the value, and a regulator able to regulate the value of the measured quantity about a setpoint value;

the method comprising the steps of:

energizing the electromagnet with the electric current, the measured quantity having a movement value able to cause a movement of the moving part from the first position to the second position, moving of the moving part from the first position to the second position, acquisition, with a sampling period, of a sample of the measured value, the method comprising the steps of:

regulating of the electric current about a setpoint value by a proportional-integral-derivative algorithm, the setpoint value being greater than or equal to a maintenance value capable of maintaining the moving part in the second position, comparing of each sample to a predetermined threshold strictly larger than the maintenance value, and detecting of an unwanted movement of the moving part if a single sample is above or equal to the threshold, in absolute value.

2. The method of control according to claim 1, wherein, following the detection of an unwanted movement, the control device carries out a step of energizing the electromagnet with the electric current, the measured quantity having the movement value.

3. The method of control according to claim 1, wherein a difference between the threshold and the maintenance value is less than or equal, in absolute value, to 15 percent of the maintenance value, preferably less than or equal to 5 percent of the maintenance value.

4. The method of control according to claim 1, wherein the proportional-integral-derivative algorithm has a derivative coefficient equal to zero.

5. The method of control according to claim 1, wherein the sampling period is less than or equal to 500 microseconds, a proportional coefficient and an integral coefficient being defined for the proportional-integral-derivative algorithm, the proportional coefficient being between 1 percent of the integral coefficient and 10 percent of the integral coefficient.

6. An actuator device comprising an electromagnet and a control device, the electromagnet comprising a coil and a moving part able to move relative to the coil between a first position and a second position, the control device comprising:

a power supply member configured to energize the coil an electric current, the electric current being able to cause a movement of the moving part from the first position to the second position, when a measured quantity of the electric current has a movement value, and being able to hold the moving part in the second position when this measured quantity has a maintenance value strictly less, in absolute value, than the movement value, a measurement member for measuring at least one value of the measured quantity, a sampling member configured to acquire samples of the measured value, with a sampling period, and a regulator able to regulate the value of the measured quantity about a setpoint value;

characterized in that the regulator is configured to regulate the value of the measured quantity by a proportional-integral-derivative algorithm, to compare each measured sample to a predetermined threshold strictly greater than the maintenance value and to detect an unwanted movement of the moving part if a single sample of the measured value is greater than or equal to the threshold, in absolute value.

7. An electrical switching device comprising an input terminal, an output terminal, a moving contact and an actuator device able to move the moving contact between a closed position in which the input terminal is electrically connected to the output terminal and an open position in which the input terminal is electrically isolated from the output terminal, characterized in that the actuator device is according to claim 6.

8. The electrical switching device according to claim 7, wherein the electrical switching device is a contactor.

9. The electrical switching device according to claim 7, wherein the electrical switching device is a circuit breaker.

10. The electrical switching device according to claim 7, wherein the electrical switching device is an electronic relay.

11. The electrical switching device according to claim 7, wherein the electrical switching device is a source inverter.

* * * * *